US011554933B2

(12) United States Patent
Viljanen et al.

(10) Patent No.: US 11,554,933 B2
(45) Date of Patent: Jan. 17, 2023

(54) ELEVATOR

(71) Applicant: KONE Corporation, Helsinki (FI)

(72) Inventors: Mikko Viljanen, Helsinki (FI); Juha-Matti Aitamurto, Helsinki (FI); Tuukka Kauppinen, Helsinki (FI); Riku Lampinen, Helsinki (FI); Toni Kallio, Helsinki (FI); Veli-Matti Virta, Helsinki (FI)

(73) Assignee: KONE CORPORATION, Helsinki (FI)

( * ) Notice: Subject to any disclaimer, the term of this patent is extended or adjusted under 35 U.S.C. 154(b) by 421 days.

(21) Appl. No.: 16/883,212

(22) Filed: May 26, 2020

(65) Prior Publication Data

US 2020/0391976 A1 Dec. 17, 2020

(30) Foreign Application Priority Data

Jun. 14, 2019 (EP) ..... 19180235

(51) Int. Cl.
*B66B 1/32* (2006.01)
*B66B 1/34* (2006.01)
(Continued)

(52) U.S. Cl.
CPC ..... *B66B 1/32* (2013.01); *B66B 1/3407* (2013.01); *B66B 1/3461* (2013.01);
(Continued)

(58) Field of Classification Search
CPC ..... B66B 5/02; B66B 5/18; B66B 5/0031; B66B 1/32; B66B 5/04; B66B 5/16;
(Continued)

(56) References Cited

U.S. PATENT DOCUMENTS 7,546,903 B2 6/2009 Kattainen et al.
2020/0024105 A1* 1/2020 Lampinen ..... B66B 1/30

FOREIGN PATENT DOCUMENTS

CN 101186259 A 5/2008
CN 105984775 A * 10/2016 ..... B66B 1/32
(Continued)

OTHER PUBLICATIONS

Extended European Search Report, issued in Priority Application No. 19180235.4, dated Feb. 25, 2020.

*Primary Examiner* — Marlon T Fletcher
(74) *Attorney, Agent, or Firm* — Birch, Stewart, Kolasch & Birch, LLP

(57) ABSTRACT

An elevator includes an elevator shaft defined by surrounding walls and top and bottom end terminals; an elevator car vertically movable in the elevator shaft; elevator hoisting ropes coupled to the elevator car; an elevator hoisting machine including a traction sheave engaged with the elevator hoisting ropes; a traction monitor configured to determine traction of the hoisting machine; an electromechanical brake; a measuring apparatus adapted to provide speed data and position data of the elevator car; and a safety processor associated with the traction monitor and the measuring apparatus. The safety processor includes an ETLS threshold configured to decrease towards the top and/or bottom end terminal in accordance with the position of the elevator car. The ETSL threshold is adjusted on the basis of the traction of the hoisting machine. The safety processor is configured to determine an elevator car slowdown failure if the speed data meets or exceeds the ETSL threshold.

20 Claims, 3 Drawing Sheets

(51) Int. Cl.
*B66B 5/00* (2006.01)
*B66B 5/06* (2006.01)
*B66B 5/28* (2006.01)

(52) U.S. Cl.
CPC ..... *B66B 1/3492* (2013.01); *B66B 5/0031* (2013.01); *B66B 5/06* (2013.01); *B66B 5/28* (2013.01)

(58) Field of Classification Search
CPC ..... B66B 5/0037; B66B 1/3492; B66B 5/00; B66B 5/185; B66B 5/0018; B66B 3/02; B66B 7/1215; B66B 5/0006; B66B 5/028
See application file for complete search history.

(56) References Cited

FOREIGN PATENT DOCUMENTS

| | | | | | |
|---|---|---|---|---|---|
| CN | 112079222 | A | * | 12/2020 | ..... B66B 1/32 |
| EP | 1 431 229 | A1 | | 6/2004 | |
| EP | 2 743 225 | A2 | | 6/2014 | |
| EP | 3750837 | A1 | * | 12/2020 | ..... B66B 1/32 |
| EP | 3753891 | A1 | * | 12/2020 | ..... B66B 1/32 |
| EP | 3848317 | A1 | * | 7/2021 | |
| EP | 3878790 | A1 | * | 9/2021 | ..... B66B 1/28 |
| EP | 3560874 | B1 | * | 12/2021 | ..... B66B 1/3407 |
| ES | 2906236 | T3 | * | 4/2022 | ..... B66B 3/00 |
| WO | WO-2010100316 | A1 | * | 9/2010 | ..... B66B 1/32 |
| WO | WO-2010107409 | A1 | * | 9/2010 | ..... B66B 5/044 |

* cited by examiner

ELEVATOR

BACKGROUND

The present invention relates to elevator speed monitoring. Elevators have electromechanical brakes that apply to a traction sheave or rotating axis of a hoisting machine to stop movement of the hoisting machine and therefore an elevator car driven by the hoisting machine. A hoisting machine normally has two electromechanical brakes. The brakes have to be dimensioned to stop and hold an elevator car with 125% load (25% overload) at standstill in the elevator shaft. The brakes may be used in emergency braking to stop the elevator car if an operational anomaly occurs, such as an overspeed situation of the elevator car.

Elevator may have hoisting ropes to drive and/or suspend elevator car. Traditionally elevator is driven with steel ropes running via the traction sheave of the hoisting machine. When hoisting machine brakes are closed to stop elevator car movement, steel ropes slip on the traction sheave to reduce deceleration of the elevator car.

Recently new kind of coated hoisting ropes have been introduced. These may be traditional round steel ropes with a high-friction coating, or belts with high-friction coating, such as a polyurethane coating. Load-carrying parts of the belts may be steel cords or they can be made of synthetic fibers, such as glass fibers or carbon fibers, for example.

These new kind of coated hoisting ropes cause a higher friction between the ropes and the traction sheave.

Decrease of the friction between the hoisting ropes and traction sheave of the hoisting machine may cause problems in elevator usage. This decrease may be due to several reasons, such as insufficient or wrong king of grease of steel ropes, degradation of the coating of coated hoisting ropes, degradation of coating of a coated traction sheave, etc.

SUMMARY

Objective of the invention is to provide a solution for ensuring safety of an elevator in case of change of friction between the hoisting ropes and traction sheave of the hoisting machine. This problem is solved with the elevator of claim 1. Some embodiments and combinations of different embodiments are presented in other claims as well as in description and drawings.

According to the invention, an elevator is provided. The elevator comprises an elevator shaft defined by surrounding walls and top and bottom end terminals; an elevator car vertically or obliquely (i.e. having both a horizontal and a vertical movement component) movable in the elevator shaft; elevator hoisting ropes coupled to the elevator car; elevator hoisting machine comprising a traction sheave, which is engaged with the elevator hoisting ropes; traction monitoring means configured to determine traction of the hoisting machine; an electromechanical braking apparatus; a measuring apparatus adapted to provide speed data and position data of the elevator car; and a safety processing unit associated with the traction monitoring means and the measuring apparatus. The safety processing unit comprises an ETSL (emergency terminal speed limit) threshold, which is configured to decrease towards the top and/or bottom end terminal in accordance with the position of the elevator car. The ETSL threshold is adjusted on the basis of the traction of the hoisting machine. The safety processing unit is configured to determine a speed parameter from the speed data of the elevator car, and to determine an elevator car slowdown failure if the speed parameter meets or exceeds the ETSL threshold. The safety processing unit is adapted to cause braking of the hoisting machine with the electromechanical braking apparatus upon determination of the slowdown failure.

This can mean that an electronic safety system with a programmable safety processing unit and measuring devices communicatively connected to the programmable safety processing unit is used to initiate the safety-related ETSL (emergency terminal speed limit) elevator braking function. With the ETSL (emergency terminal speed limit) threshold decreasing towards the top and/or bottom end terminal in accordance with the position of the elevator car, a faster reaction time and thus enhanced safety can be achieved for stopping of an approaching elevator car with the electromechanical braking apparatus in the proximity of the top and/or bottom end terminal. Further, as the ETSL threshold according to the invention is adjusted on the basis of traction of the hoisting machine, reaction time for emergency stopping of the approaching elevator car in the proximity of top or bottom end terminal can be adapted to be in line with the prevailing traction of the hoisting machine. For example, if it is determined that traction of the hoisting machine has decreased (e.g. friction coefficient between traction sheave and hoisting ropes has decreased), ETSL threshold can be lowered such that electromechanical braking apparatus is triggered to brake movement of an approaching elevator car at a lower triggering level.

According to an embodiment, the hoisting machine comprises an encoder configured to provide data of speed of rotation of the elevator hoisting machine. The traction monitoring means comprises: an input channel to receive data of speed of rotation of the elevator hoisting machine; an input channel to receive prevailing drive parameter of the elevator; and a processing means configured to determine traction of the hoisting machine from the difference between speed data of the elevator car and data of speed of rotation of the elevator hoisting machine, in combination with the prevailing drive parameter of the elevator. This can mean that traction can be determined accurately and regularly, and preferably during normal elevator operation, by using the prevailing drive parameter.

According to an embodiment, the prevailing drive parameter may be at least one of the following: elevator car load, acceleration of elevator car, deceleration of elevator car, maximum speed of elevator car. This can mean that traction may be determined during acceleration or deceleration of elevator car, in which case higher torque is present at the traction sheave of the hoisting machine. Additionally or alternatively, traction may be determined when elevator car is substantially full or empty, as slipping of ropes on the traction sheave is more likely in this situation when significant unbalance between elevator car and counterweight exists.

According to an embodiment, the measuring apparatus comprises a first measuring device adapted to provide speed data and first position data of the elevator car and a second measuring device adapted to provide a second position data of the elevator car. The safety processing unit is communicatively connected to the first measuring device and the second measuring device and configured to determine a synchronized position of the elevator car from the first and the second position data. The ETSL threshold is configured to decrease towards the top and/or bottom end terminal in accordance with the synchronized position of the elevator car. Synchronized position means position data provided by the first measuring device and then verified and, if necessary, also corrected by means of independent position data from the second measuring device, to improve reliability and accuracy and thus safety of said position data. In an embodiment, the first measuring device is a pulse sensor unit and the second measuring device is a door zone sensor.

According to an embodiment, the safety processing unit is adapted to cause braking of the hoisting machine with the electromechanical braking apparatus to decelerate car speed to the terminal speed of the top or bottom end terminal upon determination of the slowdown failure.

The first measuring device may be flexibly disposed in suitable positions in the elevator system. For example, the first measuring device may be a pulse sensor unit mounted to suitable elevator components, such as to an elevator car, to an overspeed governor, to a guide roller of an elevator car and/or at one or more elevator landings.

According to an embodiment, the pulse sensor unit is mounted to rope pulley of an elevator car. Elevator car may be suspended on the hoisting ropes through the rope pulley. The pulse sensor unit may be adapted to measure rotation speed of the rope pulley. Rotation speed of the rope pulley indicates speed of the hoisting ropes running via the rope pulley, and therefore speed of the car. This is because speed of the hoisting ropes is related to speed of the car, in accordance with the suspension ratio of the elevator.

According to an embodiment, the elevator comprises a safety buffer of an elevator car associated with the bottom end terminal of the elevator shaft.

According to an embodiment, a safety buffer of an elevator car or a safety buffer of a counterweight is associated with the top end terminal of the elevator shaft.

According to an embodiment, the safety processing unit is adapted to cause braking of the elevator car with the electromechanical braking apparatus to decelerate car speed to the terminal speed of the top or bottom end terminal upon determination of the slowdown failure. Terminal speed of the top or bottom end terminal means highest allowed speed at said top or bottom end terminal. Highest allowed speed of the top end terminal may be zero speed, to avoid collision at the top end terminal. If the elevator comprises a safety buffer of an elevator car associated with the bottom end terminal of the elevator shaft, terminal speed of the bottom end terminal may be the allowed buffer impact speed, i.e. the highest allowed structural speed of the safety buffer for elevator car to safely hit the buffer. If the elevator comprises a safety buffer of a counterweight associated with the bottom end terminal of the elevator shaft, terminal speed of the top end terminal may be the allowed buffer impact speed, i.e. the highest allowed structural speed of the safety buffer for the counterweight to safely hit the buffer.

According to an embodiment, the electromechanical braking apparatus is used for the safety-related ETSL (emergency terminal speed limit) elevator braking function.

According to an embodiment, the safety processing unit is configured to calculate from the current speed data onwards, with the maximum acceleration, speed prediction for the elevator car speed after reaction time of the electromechanical braking apparatus and to calculate from the current synchronized position onwards, with the maximum acceleration, the closest possible position of an approaching elevator car to the top or bottom end terminal after reaction time of the electromechanical braking apparatus, to calculate a maximum initial speed for the elevator car to decelerate from said closest possible position to the terminal speed of said top or bottom end terminal, and to determine an elevator car slowdown failure if said speed prediction meets or exceeds said maximum initial speed. In this case the speed prediction is the speed parameter and the maximum initial speed is the ETSL threshold. Maximum acceleration means highest possible (constant or variable) acceleration of the elevator car within capacity of the drive system. Reaction time of the electromechanical braking apparatus means time delay from detection of fault by the safety processing unit to the moment electromechanical braking apparatus actually engages the rotating part of the hoisting machine (in case of hoisting machine brakes) or elevator guide rail (in case of car brake) and starts braking of the elevator car.

According to an embodiment, the electromechanical braking apparatus comprises two electromechanical brakes adapted to apply a braking force to brake movement of the elevator car. Thus braking action with adequate braking force may be performed even if one electromechanical brake fails (fail-safe operation).

According to an embodiment, the electromechanical braking apparatus comprises two electromechanical hoisting machine brakes. According to an embodiment, the electromechanical braking apparatus comprises more that two, such as three or four, electromechanical hoisting machine brakes.

According to an embodiment, the electromechanical braking apparatus is dimensioned to stop the elevator car when it is travelling downward at nominal speed and with a 25% overload.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION

The following description illustrates a solution that monitors elevator car movement in the proximity of end terminals of elevator shaft. In case of slowdown failure of the elevator car, emergency stop may be performed to bring elevator to a safe state. This solution may constitute an ETSL (emergency terminal speed limiting device) safety function required by elevator safety rules (EN 81-20 2014 paragraph 5.12.1.3; A17.1 2016 paragraph 2.25.4.1).

Figure 1A:
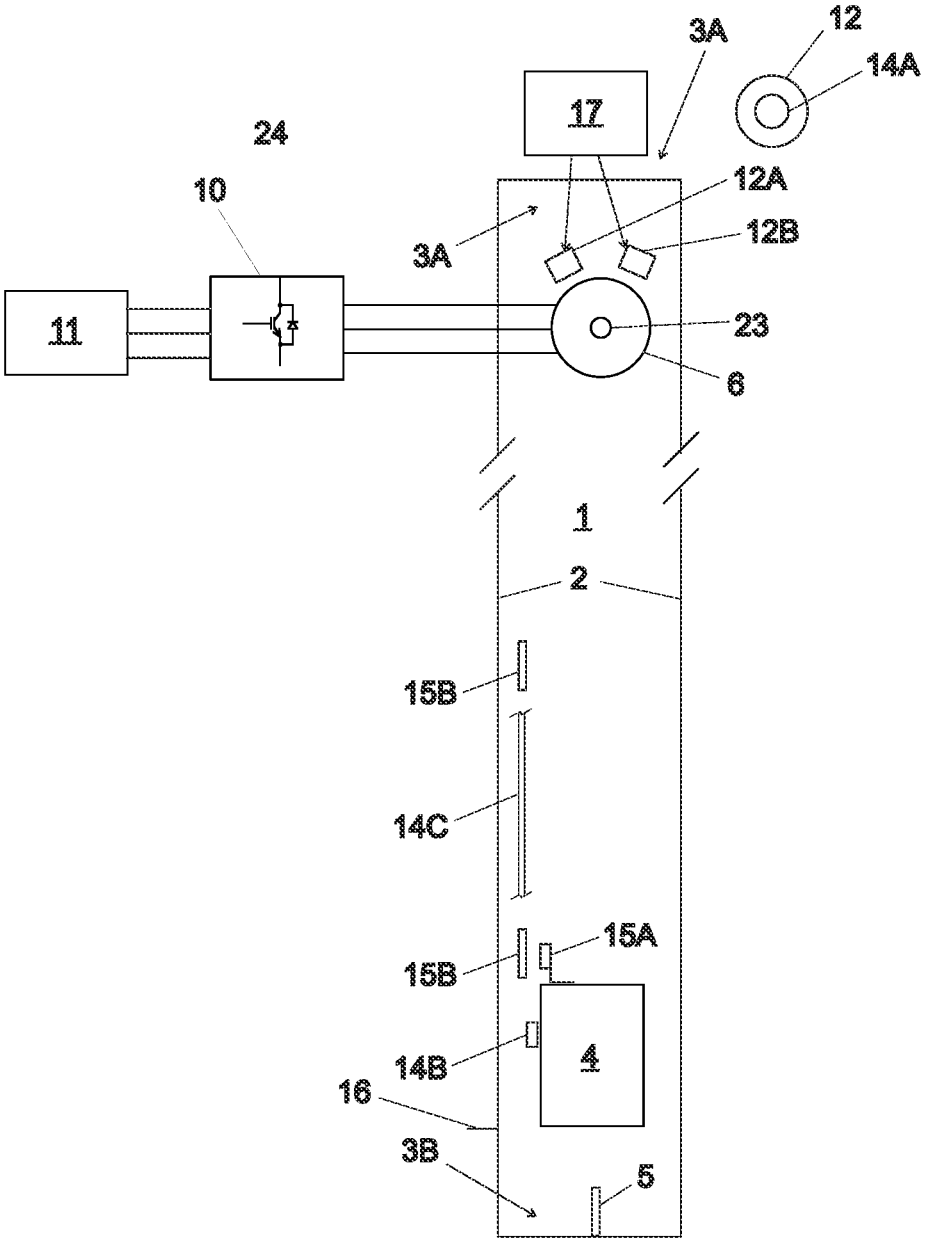
FIG. 1A illustrates a sideview of an elevator according to an embodiment.

FIG. 1A illustrates an elevator having an elevator car 4 and a counterweight, which are arranged to move vertically in an elevator shaft 1, which is defined by surrounding walls 25 and top 3A and bottom 3B end terminals. Elevator comprises a hoisting machine 6 including a traction sheave 8. Hoisting ropes 9 of the elevator car 4 are engaged with and run via the traction sheave 8. Hoisting ropes 9 may be round ropes or they may be belts. Load-carrying parts of them may be made of steel and/or of synthetic fibers, such as glass fibers or carbon fibers, for example. Hoisting ropes 9 may be coated, for example with a high-friction coating, such as a polyurethane coating.

Figure 1B:
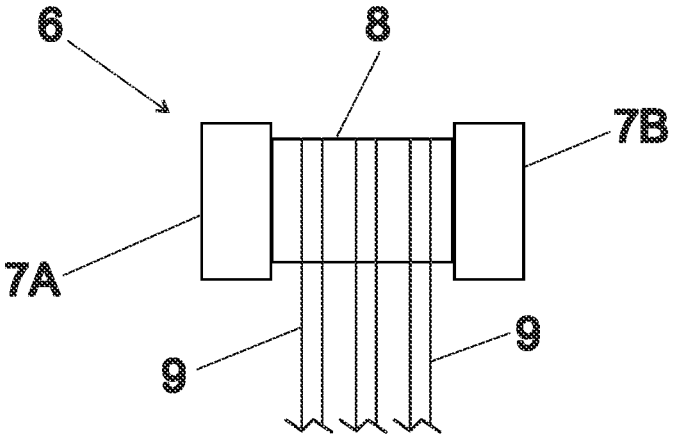
FIG. 1B illustrates a front view of an elevator hoisting machine suitable to the embodiment of FIG. 1A.

When the sheave 8 rotates, elevator car 4 moves in a first vertical direction and the counterweight moves is a second, opposite direction. Hoisting machine 6 comprises an encoder 23, which may be mounted to the rotating axis of the traction sheave 8 of the hoisting machine 6. Encoder provides data of speed of rotation of the hoisting machine 6. As depicted in FIG. 1B, hoisting machine 6 of FIG. 1A may contain two permanent magnet motors 7A, 7B arranged on the same rotating axis with the traction sheave 8. Electrical power to the permanent magnet motors 7A, 7B is provided with a drive unit 10 (e.g. a frequency converter) from the mains 11, as illustrated in FIG. 1A. Drive unit 10 performs speed regulation of the elevator car 4 moving between the landings 16 to serve elevator passengers. In some alternative embodiments, the hoisting machine 6 may contain only one permanent magnet motor 7A, 7B, which is arranged on the rotating axis with the traction sheave 8. Instead of permanent magnet motor(s), the hoisting machine 6 may contain a suitable alternative, such as an induction motor, a reluctance motor, a stator-mounted permanent magnet (SMPM) motor or corresponding.

The elevator of FIG. 1A is provided with electromechanical hoisting machine brakes 12A, 12B, as safety devices to apply braking force, either directly to the sheave 8 or via a rotating shaft, to brake movement of the hoisting machine 6 and therefore the elevator car 4. There are normally two separate brakes 12A, 12B, as illustrated in the FIG. 1A. The brakes 12A and 12B may altogether be dimensioned to stop and hold an elevator car with 125% load (25% overload) at standstill in the elevator shaft 1.

When the elevator car 4 moves in the proximity of the top 3A or bottom 3B end terminal, an ETSL (Emergency Terminal Speed Limit) safety function is used for speed monitoring of the elevator car. The phrase "in the proximity of the top 3A or bottom 3B end terminal" means the shaft section where the speed of an approaching elevator car is decelerated from nominal speed to the extreme stopping destination (e.g. to the destination landing closest to the end terminal) during normal elevator operation. Electromechanical hoisting machine brakes 12A, 12B are used to perform the emergency stop actuated by the ETSL safety function. The ETSL safety function is implemented in the safety program of the safety processing unit 17, which is a programmable elevator safety device fulfilling safety integrity level 3 (SIL 3).

Measuring apparatus of the elevator of FIG. 1A comprises a first measuring device 14A, 14B, 14C adapted to provide first position data and first speed data of the elevator car. In some embodiments the first measuring device is a pulse sensor unit 14A, 14B. Pulse sensor unit 14A may comprise a magnet ring arranged in the overspeed governor OSG 12. Alternatively, in the pulse sensor unit 14B the magnet ring may be arranged in a roller guide RG of the elevator car 4. The pulse sensor unit 14A, 14B may comprise at least one quadrature sensor, one or more processors, one or more memories being volatile or non-volatile for storing portions of computer program code and any data values, a communication interface and possibly one or more user interface units. The mentioned elements may be communicatively coupled to each other with e.g. an internal bus. The at least one quadrature sensor is configured to measure incremental pulses from the rotating magnet ring arranged in OSG or RG. The magnetic ring may comprise alternating evenly spaced north and south poles around its circumference. The at least one quadrature sensor may be a Hall sensor, for example. Furthermore, the at least one quadrature sensor has an A/B quadrature output signal for the measurement of magnetic poles of the magnet ring. Furthermore, the at least one quadrature sensor may be configured to detect changes in the magnetic field as the alternating poles of the magnet pass over it. The output signal of the quadrature sensor may comprise two channels A and B that may be defined as pulses per revolution (PPR). Furthermore, the position in relation to the starting point in pulses may be defined by counting the number of pulses. Since, the channels are in quadrature more, i.e. 90 degree phase shift relative to each other, also the direction of the rotation may be defined. The communication interface provides interface for communication with the at least one quadrature sensor and with the safety processing unit 17. The communication interface may be based on one or more known communication technologies, either wired or wireless, in order to exchange pieces of information as described earlier. Preferably, the communication interface may be implemented as a safety bus with at least partly duplicated communication means.

The processor of the pulse sensor unit is at least configured to obtain the quadrature signal from the at least one quadrature sensor, define the pulse position information based on the quadrature signals, define speed based on pulse intervals and/or number of pulses per time unit, and to store the defined pulse position information and speed into the memory. The processor is thus arranged to access the memory and retrieve and store any information therefrom and thereto. For sake of clarity, the processor herein refers to any unit suitable for processing information and control the operation of the pulse sensor unit, among other tasks. The operations may also be implemented with a microcontroller solution with embedded software. Similarly, the memory is not limited to a certain type of memory only, but any memory type suitable for storing the described pieces of information may be applied in the context of the present invention.

In an alternative embodiment, the first measuring device 14C may be implemented with a tape extending along elevator car trajectory in the shaft 1. The tape may contain readable markings. The readable markings may be for example optically readable markings, such as a barcode or 2D barcode, or in the form of variable magnetic field, which can be read with a suitable sensor, such as one or more hall-sensors. Elevator car may have a suitable reader device adapted to read the markings of the tape. The reader device may be configured to determine first elevator car position from the markings of the tape, as well as elevator car speed from the timely variation of the markings as elevator car 4 passes them. The reader device may be communicatively connected to the safety processing unit 17 via a suitable communication channel, such as a safety bus.

Further, the measuring apparatus of the elevator of FIG. 1A may comprise a second measuring device 15A, 15B. In the embodiment of FIG. 1A the second measuring device is a door zone sensor comprising a reader device 15A mounted to elevator car 4 and magnets 15B mounted to each landing 16 to indicate door zone position, i.e. the position at which landing floor and elevator car floor are at same level to allow entering or exiting the car. The reader device has hall sensors and a processor. Reader device 15A is adapted to read variation of magnetic field from the magnet 15B and determine linear door zone position of the elevator car 4 therefrom. Each magnet 15B may also comprise an identification of the magnet. Identification may be included in the magnetic field pattern of the magnet 15B. Identification may also be implemented with a separate portion, such as with an rfid tag. In this case reader device 15A may comprise an rfid tag reader. With the identification it is possible to determine absolute door zone position of the elevator car 4 when car arrives to the magnet 15B. The reader device 15A is communicatively connected to the safety processing unit 17 via a suitable communication channel, such as a safety bus running in the travelling cable between elevator car 4 and the safety processing unit 17.

Every time the elevator car 4 arrives to the landing magnet 15B (e.g. stops to the magnet or passes it), absolute door zone position of elevator car 4 is determined and sent to the safety processing unit 17. During normal operation, safety processing unit 17 compares the first elevator car position received from the first measuring device 14A, 14B, 14C with the absolute door zone position received from the second measuring device 15A, 15B and synchronizes the first position information with the absolute door zone position. Thus, if there is only a minor difference between the compared positions, safety processing unit 17 corrects the first position information by adding a correction term to the first position information such that the first position information corresponds to the absolute door zone position of the second measuring device. If the comparison leads to the conclusion that the difference between first position information and absolute door zone position is too high to be allowable, safety processing unit 17 cancels normal elevator operation until a corrective measure, such as a maintenance operation or a low-speed calibration run of the elevator car is carried out.

Alternatively or in addition, the first position information and/or elevator car speed and/or the absolute door zone position information of the elevator car 4 may be defined at two channels in order to certainly meet the SIL3 level reliability. In order to define two-channel position/speed information the pulse position information and door zone information may be obtained at two channels. The two-channel pulse position and speed information may be obtained from of the pulse sensor unit comprising one quadrature sensor and at least one processor at each channel. Furthermore, the two-channel door zone position information may be obtained from the door zone sensor unit comprising at least one Hall sensor and at least one processor at each channel.

The above presented method safety control unit, and elevator system may be implemented for two channels similarly as described above for one channel.

Figure 2:
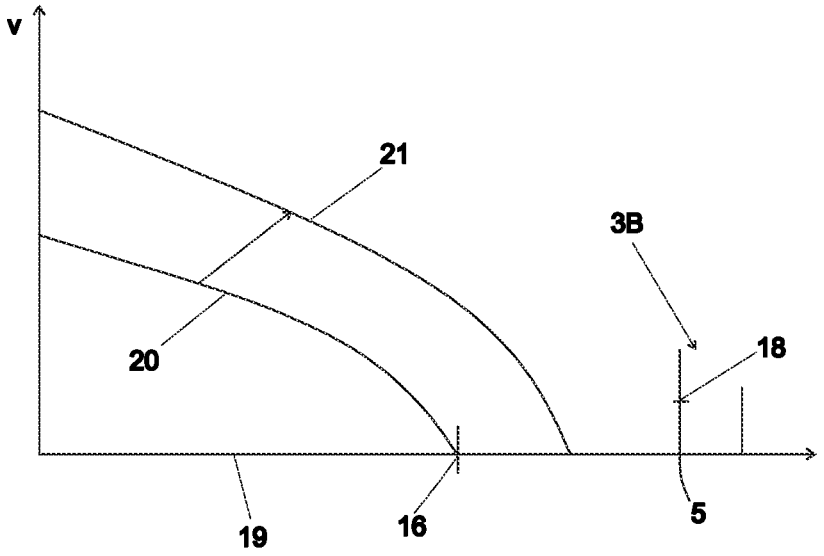
FIG. 2 illustrates implementation of speed prediction for elevator car speed according to an embodiment.
Figure 3:
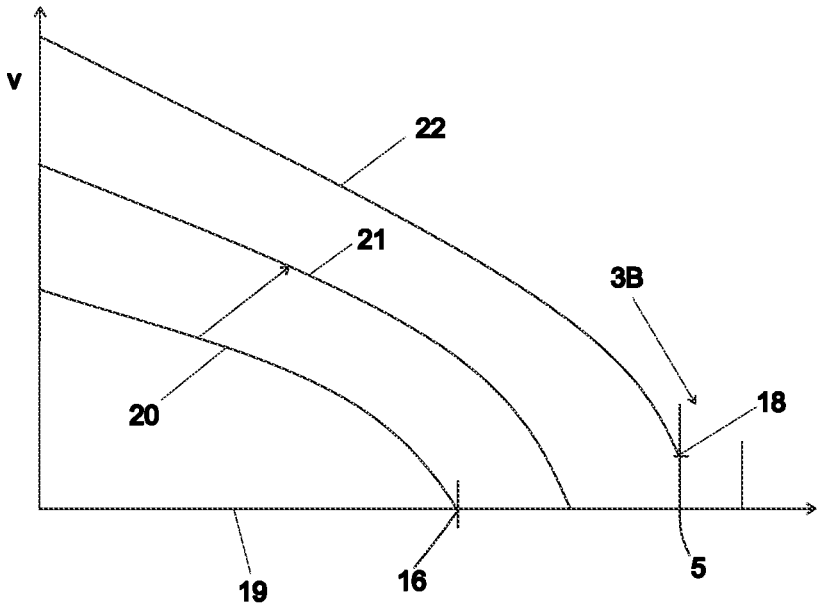
FIG. 3 illustrates determination of elevator car slowdown failure according to an embodiment.

Next, FIGS. 2 and 3 are used to illustrate how the ETSL safety monitoring function is carried out by means of the safety processing unit 17.

As already mentioned above, the safety processing unit 17 receives first position data of elevator car from the first measuring device 14A, 14B, 14C and absolute door zone position information (second position data) from the door zone sensor (second measuring device) and determines synchronized position 19 of the elevator car from the first and second position data.

Safety processing unit 17 receives also elevator car speed data from the first measuring device 14A, 14B, 14C. By means of the synchronized position and the elevator car speed data, safety processing unit 17 performs ETSL monitoring. When the ETSL monitoring results in determining a slowdown failure of an elevator car approaching the end terminal 3A, 3B of the elevator shaft, safety processing unit 17 causes braking of the elevator car 4 with the electromechanical hoisting machine brakes 12A, 12B. Next, more detailed implementation of the ETSL monitoring is disclosed.

In FIG. 2 it is illustrated, how the safety processing unit 17 calculates a speed parameter (speed prediction $v_p$) from the elevator car speed data 20. Safety processing unit 17 calculates from the current elevator car speed data 20 ($v_0$) onwards, with the maximum acceleration ($a_{max}$), the speed prediction 21 ($v_p$) for the elevator car speed after reaction time tr of the electromechanical hoisting machine brakes 12A, 12B:

$$v_p = v_0 + \int_0^{t_r} a_{max}(t)\,dt. \tag{1}$$

Maximum acceleration $a_{max}$ means the highest possible constant or variable acceleration of the elevator car within capacity of the drive system; in other words the highest possible acceleration of elevator car in case of an operational anomaly of the drive system. Therefore, the speed prediction 21 ($v_p$) gives the worst-case scenario for elevator car speed in case of an operational anomaly. Reaction time $t_r$ means estimated time delay from detection of a fault by the safety processing unit 17, to the moment that braking torque of the hoisting machine brakes 12A, 12B has increased to an adequate level, to decelerate elevator car 4 movement. In some embodiments the adequate level is nominal braking torque. In some other embodiments the adequate level may be lower, for example ⅔ of the nominal braking torque.

In some alternative embodiments, current elevator car speed data 20 ($v_0$) may be used as the speed parameter instead of speed prediction 21 ($v_p$).

Turning now to FIG. 3, the safety processing unit 17 calculates from the current synchronized position 19 ($x_0$) onwards, with the maximum acceleration $a_{max}$, the closest possible position ($x_p$) of an approaching elevator car 4 to the top 3A or bottom 3B end terminal of the elevator shaft 1 after reaction time tr of the electromechanical braking apparatus 12A, 12B:

$$x_p = x_0 + v_0 t_r + \iint_0^{t_r} a_{max}(t)\,d^2t \tag{2}$$

Therefore, the calculated closest possible position $x_p$ gives the worst-case scenario for the initial position when braking of the approaching elevator car starts in case of an operational anomaly of the drive system.

The safety processing unit 17 calculates maximum initial speed 22 ($v_{lim}$) for the elevator car 4 to decelerate, with the minimum average deceleration $a_{br}$ resulting from the combined (average) braking torque of the hoisting machine brakes 12A, 12B and the inductive braking device 13A, 13B; 7A, 7B from said closest possible position $x_p$ to the terminal speed $v_t$ of said top 3A or bottom 3B end terminal:

$$v_{lim}\sqrt{v_t^2 + 2a_{br} * x_p} - v_s \tag{3}$$

In this embodiment the maximum initial speed $v_{lim}$ constitutes an ETSL (emergency terminal speed limit) threshold. ETSL threshold decreases toward the end terminal in accordance with the synchronized position 19 ($x_0$). In the current embodiment terminal speed $v_t$ of top end terminal 3A is zero and terminal speed $v_t$ of bottom end terminal 3B is highest allowed buffer impact speed 18. Buffer impact speed depends on the dimensioning of the buffer and it could be, for example a fixed value between 3.5 m/s and 1 m/s. However the value could be even higher or lower.

The safety processing unit 17 determines an elevator car slowdown failure if the speed parameter (speed prediction 21 $v_p$) exceeds the ETSL threshold (maximum initial speed $v_{lim}$). In some embodiments, an application-specific safety margin $v_s$ is also added to the equation (3) above to slightly lower the ETSL threshold $v_{lim}$. The safety margin $v_s$ may be, for example, 2-5% of the nominal travelling speed of the elevator car 4. Upon determination of the slowdown failure, the safety processing unit 17 generates safety control commands for the hoisting machine brakes 12A, 12B. Safety control command may be, for example, a data signal sent via a safety bus or it may be implemented by cutting a safety signal, which is continuously active during normal elevator operation.

Responsive to the safety control command, hoisting machine brakes are actuated to brake movement of the elevator car 4. To enable this, the hoisting machine brakes 12A, 12B are dimensioned to decelerate car speed from the ETSL threshold ($v_{lim}$) to the terminal speed of said top 3 or bottom 3B end terminal within the distance between the closest possible position $x_p$ of an approaching elevator car 4 and the top 3A or bottom 3B end terminal.

In the equation (3) above, average deceleration $a_{br}$ may vary, for example, because of degradation of the friction between the hoisting ropes 9 and traction sheave 8 of the hoisting machine 6. This decrease of friction may be consequence of insufficient or wrong king of grease of steel ropes, degradation of coating of coated hoisting ropes or coated traction sheave, among others.

To address this problem the elevator of FIG. 1A comprises traction monitoring means configured to determine traction of the hoisting machine 6, e.g. the absolute or relative magnitude of friction or absolute or relative change of magnitude of friction between traction sheave 8 and hoisting ropes 9. If decrease in the traction of the hoisting machine is determined, deceleration $a_{br}$ in equation (3) is diminished and therefore ETSL threshold ($v_{lim}$) is lowered such that electromechanical braking apparatus is triggered at a lower triggering level.

In the embodiment of FIG. 1A, safety processing unit 17 performs traction monitoring. It receives data of speed of rotation of the elevator hoisting machine 6 from the encoder 23 and compares it with elevator car speed data. Safety processing unit 17 determines magnitude of slipping of the hoisting ropes 9 on the traction sheave 8 from the difference between speed data of the elevator car and data of speed of rotation of the elevator hoisting machine 6. This difference, when combined with prevailing drive parameter of the elevator (e.g. load weight of elevator car, acceleration of elevator car, deceleration of elevator car and/or maximum speed of elevator car) gives information of traction of the hoisting machine 6. When considerable slipping of hoisting ropes 9 is detected under lower-stress conditions (smaller acceleration/deceleration/maximum speed of the car, smaller unbalance between car and counterweight etc.), degradation of traction of the hoisting machine 6 is determined and ETSL threshold (viim) is lowered accordingly. Load weight of elevator car may be measured with a load sensor mounted to elevator car, to fixing point of hoisting ropes, to the bedplate of the hoisting machine or to the mounting assembly of the hoisting machine brakes, for example.

Elevator car speed, acceleration, and/or deceleration under normal operation may also be lowered when degradation of traction is determined, to make sure that ETSL threshold is not triggered unintentionally.

After the anomaly has ended, for example, after hoisting ropes 9 have been changed or traction sheave 8 has been replaced or repaired, the safety processing unit 17 rechecks the traction in the manner described above. If reversion to higher level traction is determined, safety processing unit 17 will increase the ETSL threshold ($v_{lim}$) accordingly.

Traction monitoring may be performed in some other processing unit instead of the safety processing unit 17, such as in an elevator control unit or the drive unit 10.

The invention can be carried out within the scope of the appended patent claims. Thus, the above-mentioned embodiments should not be understood as delimiting the invention.

The invention claimed is:

1. An elevator comprising:

an elevator shaft defined by surrounding walls and top and bottom end terminals;

an elevator car moveable in the elevator shaft;

elevator hoisting ropes coupled to the elevator car;

an elevator hoisting machine comprising a traction sheave engaged with the elevator hoisting ropes;

a traction monitor configured to determine traction of the hoisting machine;

an electromechanical brake;

a measuring apparatus adapted to provide speed data and position data of the elevator car; and a safety processor associated with the traction monitor and the measuring apparatus, the safety processor comprising an ETLS threshold configured to decrease towards the top and/or bottom end terminal in accordance with the position of the elevator car;

wherein the ETSL threshold is adjusted on the basis of the traction of the hoisting machine, wherein the safety processor is configured to determine a speed parameter from the speed data of the elevator car, and to determine an elevator car slowdown failure if the speed parameter meets or exceeds the ETSL threshold, and wherein the safety processor is adapted to cause braking of the hoisting machine with the electromechanical brake upon determination of the slowdown failure.

2. The elevator according to claim 1, wherein the hoisting machine comprises an encoder configured to provide data of speed of rotation of the elevator hoisting machine, and wherein the traction monitor comprises:

an input channel to receive data of a speed of rotation of the elevator hoisting machine;

an input channel to receive a prevailing drive parameter of the elevator; and a processor configured to determine traction of the hoisting machine from the difference between the speed data of the elevator car and the data of speed of rotation of the elevator hoisting machine, in combination with the prevailing drive parameter of the elevator.

3. The elevator according to claim 1, wherein the measuring apparatus comprises:

a first measuring device adapted to provide speed data and first position data of the elevator car; and a second measuring device adapted to provide second position data of the elevator car, wherein the safety processing unit is communicatively connected to the first measuring device and the second measuring device and is configured to determine a synchronized position of the elevator car from the first and the second position data, and wherein the ETLS threshold is configured to decrease towards the top and/or bottom end terminal in accordance with the synchronized position of the elevator car.

4. The elevator according to claim 1, wherein the safety processor is adapted to cause braking of the hoisting machine with the electromechanical brake to decelerate car speed to the terminal speed of the top or bottom end terminal upon determination of the slowdown failure.

5. The elevator according to claim 1, wherein the elevator comprises a safety buffer of an elevator car associated with the bottom end terminal of the elevator shaft, wherein the safety processor is adapted to cause braking of the hoisting machine with the electromechanical brake to decelerate car speed to the allowed buffer impact speed upon determination of the slowdown failure in the proximity of the bottom end terminal.

6. The elevator according to claim 1, wherein the electromechanical brake comprises two electromechanical brakes adapted to apply a braking force to brake movement of the elevator car.

7. The elevator according to claim 1, wherein the electromechanical brake comprises two electromechanical hoisting machine brakes.

8. The elevator according to claim 1, wherein the electromechanical brake is dimensioned to stop the elevator car when the elevator car is travelling downward at nominal speed and with a 25% overload.

9. The elevator according to claim 2, wherein the measuring apparatus comprises:

a first measuring device adapted to provide speed data and first position data of the elevator car;

a second measuring device adapted to provide second position data of the elevator car, wherein the safety processor is communicatively connected to the first measuring device and the second measuring device and is configured to determine a synchronized position of the elevator car from the first and the second position data, and wherein the ETLS threshold is configured to decrease towards the top and/or bottom end terminal in accordance with the synchronized position of the elevator car.

10. The elevator according to claim 2, wherein the safety processor is adapted to cause braking of the hoisting machine with the electromechanical brake to decelerate car speed to the terminal speed of the top or bottom end terminal upon determination of the slowdown failure.

11. The elevator according to claim 3, wherein the safety processor is adapted to cause braking of the hoisting machine with the electromechanical brake to decelerate car speed to the terminal speed of the top or bottom end terminal upon determination of the slowdown failure.

12. The elevator according to claim 2, wherein the elevator comprises a safety buffer of an elevator car associated with the bottom end terminal of the elevator shaft, wherein the safety processor is adapted to cause braking of the hoisting machine with the electromechanical brake to decelerate car speed to the allowed buffer impact speed upon determination of the slowdown failure in the proximity of the bottom end terminal.

13. The elevator according to claim 3, wherein the elevator comprises a safety buffer of an elevator car associated with the bottom end terminal of the elevator shaft, wherein the safety processor is adapted to cause braking of the hoisting machine with the electromechanical brake to decelerate car speed to the allowed buffer impact speed upon determination of the slowdown failure in the proximity of the bottom end terminal.

14. The elevator according to claim 4, wherein the elevator comprises a safety buffer of an elevator car associated with the bottom end terminal of the elevator shaft, wherein the safety processor is adapted to cause braking of the hoisting machine with the electromechanical brake to decelerate car speed to the allowed buffer impact speed upon determination of the slowdown failure in the proximity of the bottom end terminal.

15. The elevator according to claim 2, wherein the electromechanical brake comprises two electromechanical brakes adapted to apply a braking force to brake movement of the elevator car.

16. The elevator according to claim 3, wherein the electromechanical brake comprises two electromechanical brakes adapted to apply a braking force to brake movement of the elevator car.

17. The elevator according to claim 4, wherein the electromechanical brake comprises two electromechanical brakes adapted to apply a braking force to brake movement of the elevator car.

18. The elevator according to claim 5, wherein the electromechanical brake comprises two electromechanical brakes adapted to apply a braking force to brake movement of the elevator car.

19. The elevator according to claim 2, wherein the brake comprises two electromechanical hoisting machine brakes.

20. The elevator according to claim 3, wherein the electromechanical brake comprises two electromechanical hoisting machine brakes.

* * * * *